United States Patent [19]

Bhaskar

[11] Patent Number: 4,809,334

[45] Date of Patent: Feb. 28, 1989

[54] METHOD FOR DETECTION AND CORRECTION OF ERRORS IN SPEECH PITCH PERIOD ESTIMATES

[75] Inventor: Udaya Bhaskar, Gaithersburg, Md.

[73] Assignee: Communications Satellite Corporation, Washington, D.C.

[21] Appl. No.: 71,243

[22] Filed: Jul. 9, 1987

[51] Int. Cl.[4] ..... G10L 5/00

[52] U.S. Cl. ..... 381/49; 381/47

[58] Field of Search ..... 381/47, 49; 364/513.5

[56] References Cited

U.S. PATENT DOCUMENTS

| | | | |
|---|---|---|---|
| 3,947,638 | 3/1976 | Blankinship . | |
| 4,004,096 | 1/1977 | Bauer et al. . | |
| 4,184,049 | 1/1980 | Crochiere et al. . | |
| 4,230,906 | 10/1980 | Davis . | |
| 4,310,721 | 1/1982 | Manley | 364/513.5 |
| 4,384,335 | 5/1983 | Duifhuis et al. . | |
| 4,441,200 | 4/1984 | Fette et al. . | |
| 4,561,102 | 12/1985 | Prezas . | |
| 4,653,098 | 3/1987 | Nakata | 381/49 |

*Primary Examiner*—Emanuel S. Kemeny

*Attorney, Agent, or Firm*—Sughrue, Mion, Zinn, Macpeak, and Seas

[57] ABSTRACT

A method of detecting and correcting received values of a pitch period estimate of a speech signal for use in a speech coder or the like. An average is calculated of the nonzero values of received pitch period estimate since the previous reset. If a current pitch period estimate is within a range of 0.75 to 1.25 times the average, it is assumed correct, while if not, a correction process is carried out. If correction is required successively for more than a preset number of times, which will most likely occur when the speaker changes, the average is discarded and a new average calculated.

9 Claims, 2 Drawing Sheets

METHOD FOR DETECTION AND CORRECTION OF ERRORS IN SPEECH PITCH PERIOD ESTIMATES

The invention described herein was made in the performance of work under NASA Contract No. 957113/(MS-86-0091) and is subject to the provisions of Section 305 of the National Aeronautics and Space Act of 1958 (75 Stat. 435; 42 U.S.C. 2457).

BACKGROUND OF THE INVENTION

The present invention relates to a method for improved detection and correction of errors in pitch period estimates of speech signals.

In electronic processing of speech signals, for example, in mobile radio, maritime, aircraft and satellite communications speech coders are often employed. Examples of such speech coders include parametric and hybrid speech coders such as Linear Predictive Coders and Adaptive Predictive Encoders.

An example of a Linear Predictive Coder (LPC) is shown in the block diagram of FIG. 1. Incoming 12-bit speech samples are applied to an LPC analysis circuit 1 for vocal cavity modeling, to a voice and pitch analysis circuit 3, and to an energy matching circuit 4. The LPC analysis circuit 1 outputs LPC parameters $a_1, \ldots a_p$, to a quantizer and error control circuit 2, other inputs to which include signals from the voicing and pitch analysis circuit 3 indicative of whether the speech is voiced or unvoiced and its pitch period when voiced, and a gain parameter from the energy matching circuit. The present invention is employed in the voicing and pitch analysis circuit 3. Since, however, the overall system depicted in FIG. 1 is not the direct subject of the present invention and examples of such circuits are well known in the prior art, its details will not be discussed further here.

In these coders, it is usually necessary for the voicing and pitch analysis circuit 3 to provide estimates of the speech pitch period of the speaker and to detect and correct errors in the estimates. The invention relates directly to a method for detecting and correcting in the errors in the pitch period estimates. The pitch period estimates themselves are derived with a device and method distinct from that of the present invention.

Pitch period estimates of speech signals are susceptible to two types of error—gross pitch errors and fine pitch errors. Gross pitch errors, which are large in magnitude, typically arise due to pitch period doubling or background noise. Gross errors are perceived as distorted speech spurts that are subjectively very objectionable. On the other hand, fine pitch errors, which are much smaller in magnitude, are generally caused by limited resolution of the pitch estimation technique or time variations in the pitch period. Fine pitch errors are more tolerable, but result in the perception of a reduced natural quality to the speech. The present invention is concerned primarily with detection and correction of gross errors.

Previous methods for detecting and correcting gross errors in pitch period estimates operated primarily using median smoothing. That is, each pitch period estimate is replaced by a weighted average of itself and its neighboring estimates. All estimates are subjected to smoothing in this manner. In a somewhat more sophisticated scheme, smoothing is performed selectively. Specifically, only if an estimate differs from the average of its neighbors by more than a predetermined amount is the estimate replaced by its smoothed value.

In the first method, the gross errors are reduced at the expense of reducing the accuracy of all estimates, as a result of which fine pitch errors are introduced in all estimates. In the second method. uncorrected gross errors can cause further gross errors.

It is thus an object of the present invention to provide a method for detecting and correcting errors in speech pitch estimates which provides an improved accuracy to the estimates, and which consequently results in the elimination of the difficulties mentioned above.

SUMMARY OF THE INVENTION

This, as well as other objects of the invention, are met by a method for detecting and correcting gross errors in pitch period estimates of a speech signal, comprising the steps of: determining an average of nonzero values of received pitch period estimates, accepting a current pitch period estimate if the current pitch period estimate is within a predetermined range of the average, and correcting the current pitch period estimate if the current pitch period estimate is outside the predetermined range of the average. Preferably, the predetermined range is $0.75P(i) < p(i) < 1.25P(i)$, where P(i) is the average and p(i) is the current pitch period estimate.

DESCRIPTION OF THE PREFERRED EMBODIMENTS

For any given speaker, it has been observed that the range of pitch period values is usually much narrower than for the entire range of speakers. For the entire range of speakers, that is, for both males and females, the pitch period can vary within a range of about 2 ms to 20 ms. while any given speaker has an individual range no more than about 5 ms wide in most cases. Because each individual's range is narrow, most gross errors will fall outside the individual's range and thus can be easily detected.

In accordance with the present invention, for the incoming speech signal the location of the pitch period range within the broad overall range is determined by an adaptive pitch learning process. Because the pitch period range location is very likely to change each time the speaker changes, such changes are detected, learning reinitialized, and the new pitch period location determined.

The inventive process can be divided into three main phases:

(1) pitch period location update.

(2) pitch period estimate verification and, if necessary, correction, and (3) pitch period location verification.

Figure 1:
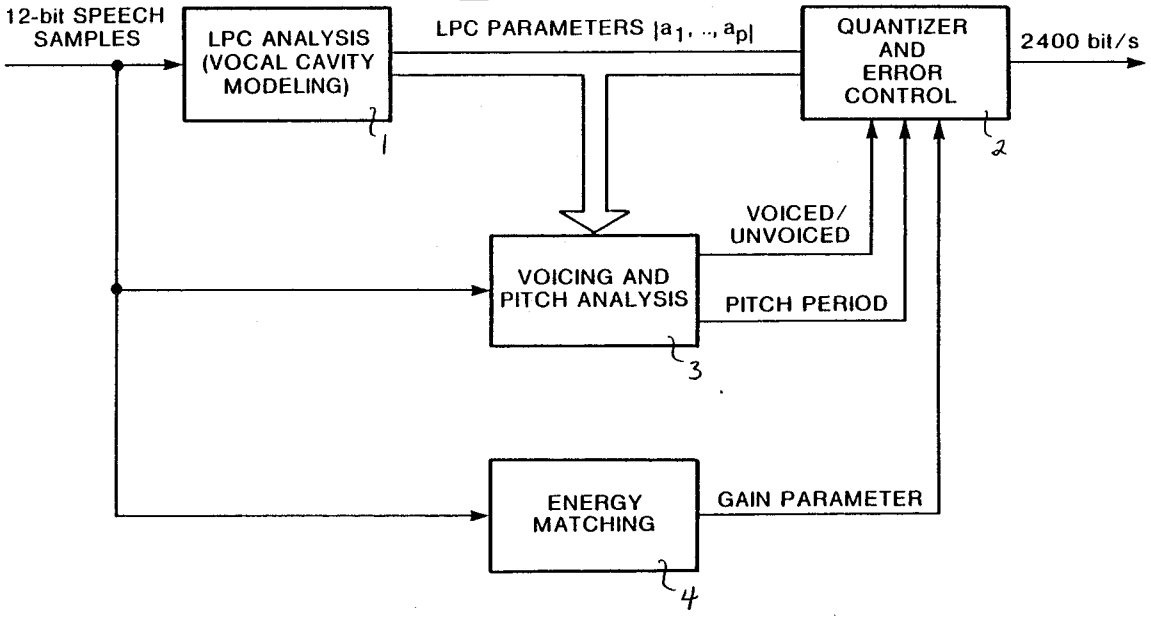
Fig. 1 PRIOR ART
FIG. 1 is a block diagram of a Linear Predictive Coder in which the invention may be advantageously employed.
Figure 2:
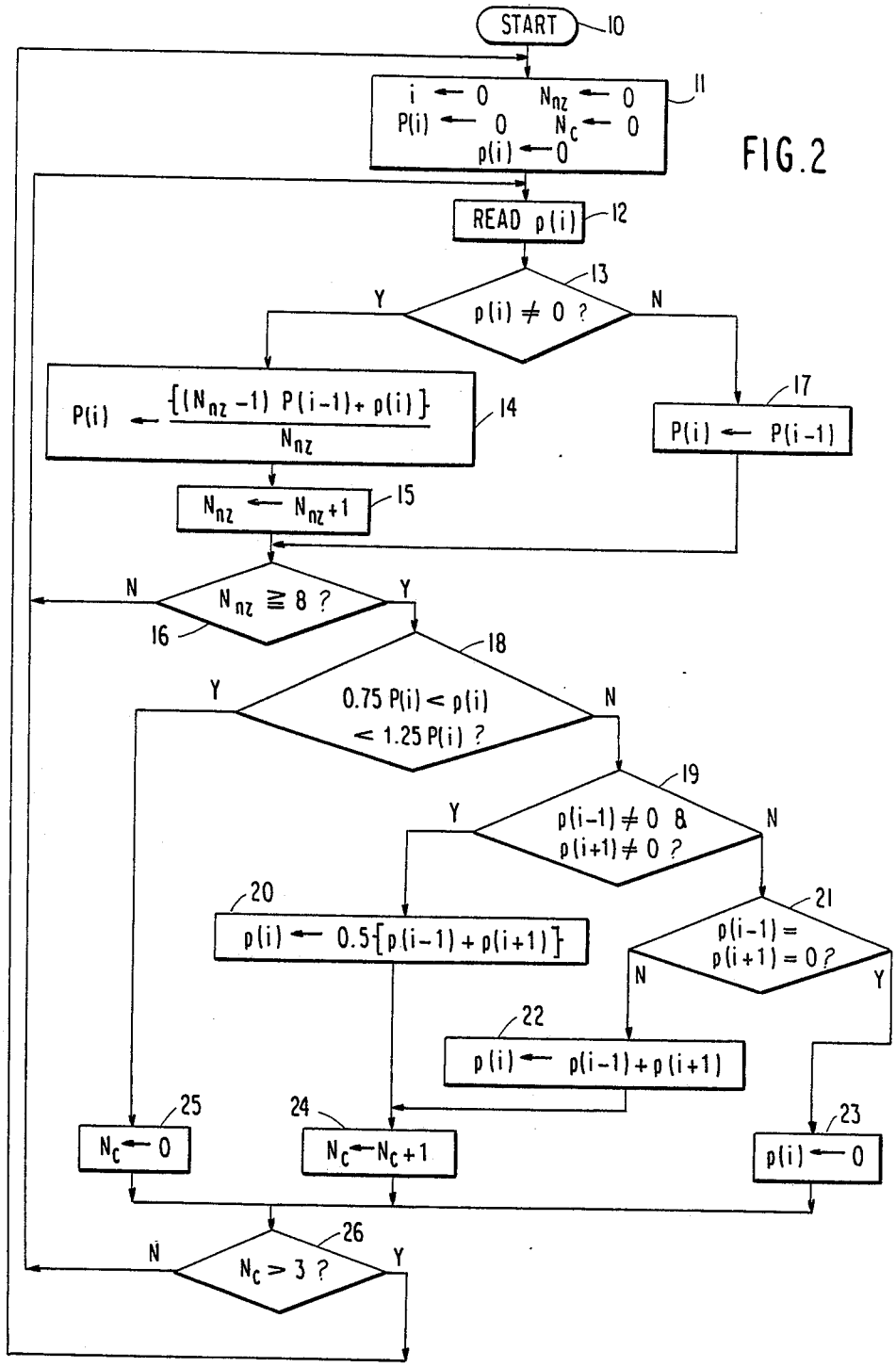
FIG. 2 is a flowchart showing steps in a preferred embodiment of a speech pitch estimate error detecting and correcting method of the present invention.

Each phase will be discussed in detail below with reference to the flowchart of FIG. 2.

(1) Pitch Period Location Update (Steps 10 to 16):

The present, the previous, and the next pitch period estimates supplied by the pitch period estimator are herein designated by p(i), p(i−1), and p(i+1), respectively. If the speech is unvoiced at any given instant, the pitch period estimate will of course be zero. P(i) is the average of all nonzero pitch periods since the most recent reset at i=0, and thus indicates the location of the present pitch range. $N_{nz}$ is the number of nonzero pitch periods since the most recent reset at i=0. $N_c$ is a correction count value.

After the START in step 10, in step 11, i, $N_{nz}$, P(i), $N_c$, and p(i) are all initialized to the zero state. In step 12, the first pitch period estimate p(i) is read from the external pitch period estimator. It is determined in step 13 whether p(i) is zero or not. If p(i) is nonzero (voiced speech), P(i) is calculated using a recursive formula in step 14. That is, the average of all nonzero pitch periods since the reset at i=0 is calculated using the formula:

$$P(i) = \frac{1}{N_{nz}} \sum_{j=0}^{i} p(j)$$

To update P(i) recursively, for nonzero p(i), the formula above can be implemented as:

$$P(i) = \frac{\{(N_{nz} - 1)P(i-1) + p(i)\}}{N_{nz}}$$

P(i) is calculated in this manner in step 14. In step 15, because p(i) is nonzero, the nonzero counter $N_{nz}$ is incremented, that is, $N_{nz} \leftarrow N_{nz}+1$. On the other hand, if p(i) is zero, in step 17 P(i) is replaced by its previous value P(i−1), which is zero for the first pass after i=0.

Because the calculated value of P(i) is not reliable until several nonzero pitch period estimates have been received, step 16 causes looping back to step 13 to update P(i) until a predetermined number of nonzero pitch period estimates have been received. In this example, the predetermined number is eight.

(2) Pitch Period Estimate Verification and Correction (Steps 18 to 25):

The pitch period p(i) is now verified for the purpose of detecting gross errors therein. The verification process is carried out only for nonzero values of p(i).

Based upon experimental studies, it has been found that, with a high probability, the correct pitch estimate p(i) lies within the range of the pitch average P(i) of 0.75P(i) to 1.25P(i). It is tested in step 18 whether p(i) is within this range. If 0.75P(i)<p(i)<1.25P(i), then the current value of p(i) is accepted as accurate, and in step 25 the correction counter value $N_c$ is reset to zero. If, however, p(i) is outside of this range, it is determined in step 19 whether the neighboring values p(i−1) and p(i+1) are both nonzero. If they are, p(i) is set equal to the average of p(i−1) and p(i+1) in step 20, while if not, a test is carried out in step 21 to determine if both p(i−1) and p(i+1) are zero. If they are both zero, it is assumed that the speech is truly unvoiced, and hence p(i) is set to zero (p(i)←0) in step 23. If though one of p(i−1) and p(i+1) is nonzero, in step 22 p(i) is set equal to the nonzero term (p(i)←p(i−1)+p(i+1)). If p(i) is corrected, that is, if p(i) is set equal to the average of p(i−1) and p(i+1) in step 20 or set equal to the nonzero one of p(i−1) and p(1+1) in step 22, the correction counter value $N_c$ is incremented in step 24 ($N_c \leftarrow N_c+1$).

(3) Pitch Period Location Verification (Step 26):

The correction counter value $N_c$ indicates the number of consecutive gross errors encountered as determined from the location of the pitch period range P(i). If the pitch period estimate is reliable, this number should remain small. Thus, if $N_c$ exceeds a certain small integer, here assumed to be three, it is likely that the pitch period location indicated by P(i) is in error, which occurs most frequently when the speaker has changed. In this case, it is necessary to discard the current value of P(i) and to start the procedure once again. That is, i, $N_{nz}$, P(i), $N_c$, and p(i) are reinitialized back in step 11, and the process is repeated in the manner already described. Verification can start again once eight nonzero pitch period estimates have been received and averaged.

Of course, the inventive method may be implemented using dedicated logic circuitry or with an appropriately programmed microcomputer or the like as desired.

With the invention as described above, gross errors in the pitch period of speech signals are quickly detected and corrected without creating further errors in these values. Accordingly, the invention provides a process of detecting and eliminating errors in pitch period estimates which is substantially improved over the prior art approaches.

This completes the description of the preferred embodiments of the invention. Although preferred embodiments have been described, it is apparent that modifications and alterations thereto can be made without departing from the spirit and scope of the invention.

What is claimed is:

1. A method for detecting and correcting gross errors in pitch period estimates of a speech signal, comprising the steps of:

determining an average of nonzero values of received pitch period estimates;

accepting a current pitch period estimate if said current pitch period estimate is within a predetermined range of said average; and correcting said current pitch period estimate if said current pitch period estimate is outside said predetermined range of said average.

2. The detecting and correcting method of claim 1, wherein said predetermined range is $$0.75P(i) < p(i) < 1.25P(i),$$

where P(i) is said average and p(i) is said current pitch period estimate.

3. The detecting and correcting method of claim 1, wherein said step of correcting said current pitch period estimate comprises:

(1) if preceding and succeeding pitch period estimates p(i−1) and p(i+1), respectively, are both nonzero, setting p(i) equal to an average of p(i−1) and p(i+1); and (2) if one of p(i−1) and p(i+1) is nonzero, setting p(i) equal to the nonzero one of p(i−1) and p(i+1).

4. The detecting and correcting method of claim 3, further comprising the step of, if both p(i−1) and p(i+1) are zero, setting p(i) equal to zero.

5. The detecting and correcting method of claim 4, further comprising the steps of:

counting a number of consecutive times of correcting said current pitch period estimate p(i) without p(i) being in said predetermined range or p(i) being set equal to zero; and discarding said average and determining a new average when the count exceeds a predetermined limit value.

6. The detecting and correcting method of claim 4, wherein said predetermined limit value is three.

7. The detecting and correcting method of claim 1, wherein said step of determining said average comprises recursively calculating:

$$P(i) = \frac{\{(N_{nz} - 1)P(i - 1) + p(i)\}}{N_{nz}}$$

where $N_{nz}$ is a number of nonzero values of p(i) included in said average.

8. The detecting and correcting method of claim 1, wherein said step of averaging comprises averaging a predetermined minimum number of nonzero values of said received pitch period estimate before proceeding to said step of accepting a current pitch period estimate.

9. The detecting and correcting method of claim 8, wherein said predetermined minimum number is eight.

* * * * *

UNITED STATES PATENT AND TRADEMARK OFFICE

CERTIFICATE OF CORRECTION

PATENT NO. : 4,809,334

DATED : February 28, 1989

INVENTOR(S) : U. BHASKAR

It is certified that error appears in the above-identified patent and that said Letters Patent is hereby corrected as shown below:

Col. 2, line 43, delete "20ms." and insert --20ms,--.

Signed and Sealed this

Third Day of October, 1989

*Attest:*

*Attesting Officer*

DONALD J. QUIGG

*Commissioner of Patents and Trademarks*